United States Patent [19]

Oltrona Visconti

[11] 4,225,179

[45] Sep. 30, 1980

[54] REMOVABLE FURNITURE COVERING

[76] Inventor: Lucchino Oltrona Visconti, Via Parini, 7, Monza, Italy

[21] Appl. No.: 969,952

[22] Filed: Dec. 13, 1980

[30] Foreign Application Priority Data

Dec. 13, 1977 [IT] Italy ..... 30650 A/77
Dec. 30, 1977 [IT] Italy ..... 31451 A/77

[51] Int. Cl.[2] ..... A47C 27/00

[52] U.S. Cl. ..... 297/219; 5/110; 297/218; 297/440

[58] Field of Search ..... 297/118, 218, 219, 283, 297/440, 442, 455, 456; 5/110, 111, DIG. 1

[56] References Cited

U.S. PATENT DOCUMENTS

| | | | |
|---|---|---|---|
| 35,289 | 5/1862 | Baldwin | 297/118 |
| 2,707,514 | 5/1955 | Smith | 297/442 X |
| 2,877,832 | 3/1959 | Beavis | 297/442 UX |
| 3,083,054 | 3/1963 | Weaver | 297/219 |
| 3,515,430 | 6/1970 | Nelson | 297/218 |
| 3,680,916 | 8/1972 | Gilbert et al. | 297/219 X |

*Primary Examiner*—James C. Mitchell

[57] ABSTRACT

A removable furniture covering adapted to transform a common seating structure, such as a deck chair, into a furniture article which can be suitably used in a living room or the like. The covering slips onto and may be fastened to the base seating structure.

10 Claims, 12 Drawing Figures

REMOVABLE FURNITURE COVERING

The present application relates to articles in the field of furnishing or interior decorating.

An object of this invention is to offer, with respect to a traditional need, an alternative in terms of cost to the usual furnishings of that area which is commonly referred to as family room or living room or sitting room. Considering the high cost which today one must face to satisfy the need of having in the home a living room, which comprises one or more arm chairs and a couch, according to this invention, it is proposed to utilize or to recover unstuffed seating furniture articles, already in common use, such as deck chair, so called "director" chair, beach cots, folding chairs in general, or even non-folding chairs, such as garden chairs. Today on the market there are a great number of these products, which are only utilized for few months of the year. However, they offer comfortable seating, adapted for rest and conversation, and are therefore functional. On the other hand, the factor which until now has prevented the continuous use of said objects is to be found in their aesthetic characteristics: light structure, not much adapted for their combination with other furniture which by necessity of use and by tradition are more visibly full in volume and in weight.

It is thereby proposed to utilize said unstuffed seating structures, such as deck chairs, director's chairs, cots, etc. as frameworks for furniture items which can be more exactly defined as "living room furniture", together with a removable or fixed covering to put on said seating structures to transform them into stuffed living room furniture, and to the articles thus obtained.

The advantages which are achieved are many: the arm-chair or the couch or sofa obtained according to the present invention present the same characteristics of the traditional items, with a cost reduced even up to about 50% with respect to the same arm-chair or couch obtained by industrial or normal techniques. It is possible to change the appearance of the item, arm-chair or couch, changing only the covering. It is also possible to greatly facilitate the transportation by packing separately the folded covering and the folded support framework (constituted by the deck chair, cot, etc.). It is possible to achieve a better hygiene since the covering can be easily removed, washed and replaced. Furthermore, the possibility of packaging and putting on sale the folded boxed coverings alone, in stores or through mail order outlets, offers a promotional advantage in the sales field.

There will now be described some non limitative examples of the object of the present application, with reference to the attached drawings in which.

Figure 1:
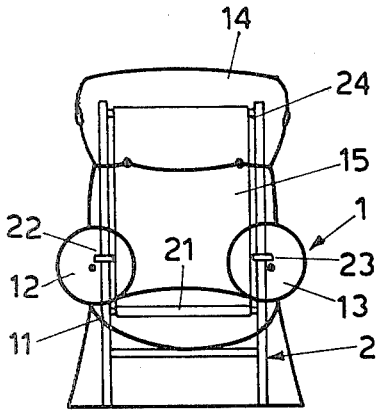
FIGS. 1, 2 and 3 illustrate an arm chair obtained with a first type of covering according to the present invention, placed onto a deck chair, and are respectively a front view (FIG. 1) with the support deck chair shown in thin lines; a side view (FIG. 2) still with the deck chair shown in thin lines; and a perspective view (FIG. 3).
Figure 2:
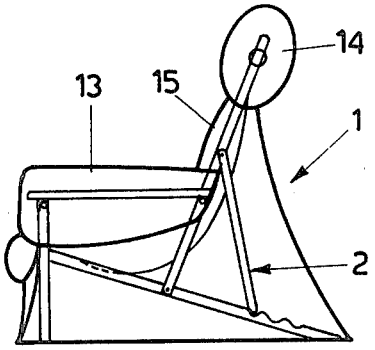
Figure 3:
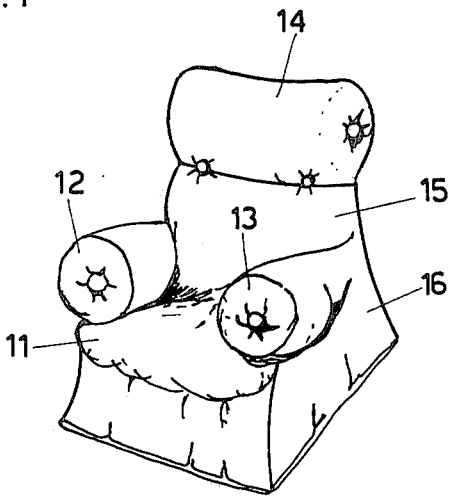

With reference to FIGS. 1, 2 and 3 it is to be noted that the covering 1 for the deck chair 2 comprises substantially an anterior section of the seat, stuffed, 11, to cover and hide the leg 21 of the seat of the deck chair, two stuffed arm rest parts 12 and 13 to cover and hide arm rests 22 and 23 of the arm chair, and a stuffed headrest part 14, to cover the upper transversal section 24 of the deck chair and to render more comfortable the leaning thereon. Arm rest parts 12 and 13 preferably have the shape of an upturned U in transverse section, as to be able to fit onto the arm rest of the deck chair, while their anterior section is closed. Similarly, the head rest part 14 preferably conforms to a transverse upturned U section, with closed ends, so as to slip on as an envelope onto the extremity of the back of the deck chair. Part 11 can have either an envelope-like configuration as part 14, or can have any other form, being maintained in place by connection with the arm rests. A wide strip or connection zone 15 connects between each other parts 11, 12, 13 and 14 in a yieldable manner (so as to permit various degrees of inclination of the deck chair) and is disposed along the cloth section of the deck chair; the strip 15 may be unstuffed, or stuffed to some degree; parts 11, 12, 13 and 14 can be fixed to it by means of sewing, snap buttons, or any other known means (in particular, parts 11 and 14 may be formed as to be integral therewith). The dimensions of the various parts and the relationship between their dimensions can vary widely, in this and other realizations of the invention.

In the realization of FIGS. 1 to 3, the covering is completed by a skirt section 16, hanging all around the chair from parts 11, 13, 14 and 12 of the covering down to the ground; the skirt section 16 may be stuffed or unstuffed, straight or pleated, or may not be present at all. The entire covering 1, composed of parts 11–16, constitutes a unitary assembly suitable to be slipped onto and slipped from the deck chair, on which it remains firmly in position in its entire reversed U shape or envelope shape, of the parts 12, 13 and 14. However, it is possible to provide also fastening means of the covering to the chair (not shown) such as string ties, snap buttons, or the like.

Figure 4:
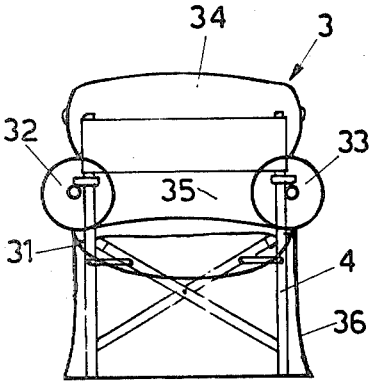
FIGS. 4, 5 and 6 show an arm chair obtained by placing a covering on a director's chair, respectively in front view (FIG. 4) with the support chair being shown in thin lines, in side view (FIG. 5) with the support chair being shown in thin lines, and in perspective view (FIG. 6).
Figure 5:
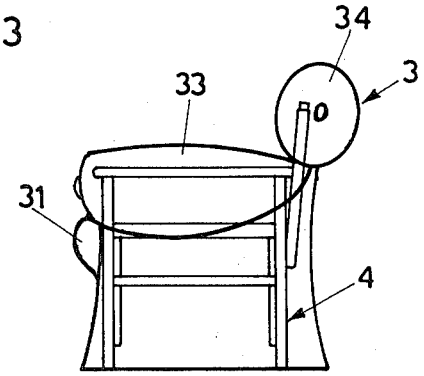
Figure 6:
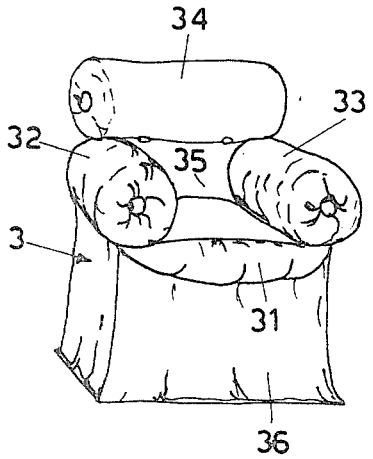

In FIGS. 4, 5 and 6 there is represented a realization of the covering, indicated as 3, suitable for a folding chair 4 of the known type as a "director's chair". Also in this case, the covering comprises an anterior part of the seat 31, stuffed; stuffed arm rest parts 32 and 33, with an internal configuration of reversed U closed at the extremity, as explained with reference to the previous realizations, to cooperate and remain attached on the arm rests of the chair, a head rest part 34, stuffed, with an anterior envelope like configuration, a connecting strip 35, more or less stuffed, and a skirt part 36, hanging down to the ground, stuffed or not, straight or pleated. The skirt part can also be eliminated. As described with reference to the previous realization, the coverings for director's chairs may freely slip onto or be slipped from the chair or they may have string ties or other fastening means.

Figure 7:
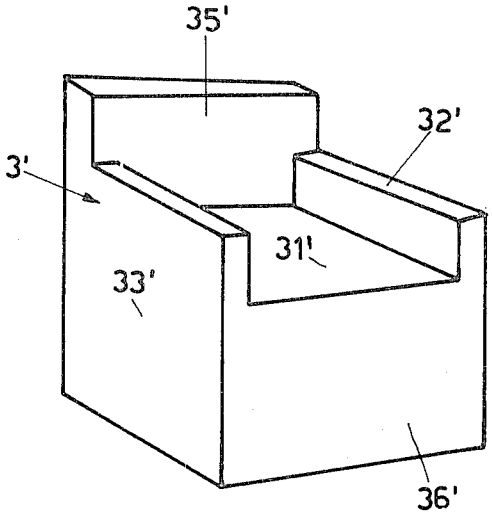
FIG. 7 represents an arm chair obtained by another type of covering, on a director's chair, in perspective view.

In FIG. 7 there is represented a further realization of the covering, illustrated in the example as a covering for a director's chair, but it is to be understood that it can be applied also to other support structures provided in the present application. It deals with a covering 3' simply obtained by conforming and in case designing the parts through sewing (or other type of assemblage) in a material which may consist of: unstuffed cloth, quilted cloth, leather, pile, plastic material, etc. or a combination thereof, straight or pleated, with or without the addition of stuffing. Such covering, which may cover totally or partially the support structure, comprises arm rest 32', 33', a seat part 31', a back part 35' and in case a skirt part 36', said parts being connected or separated from each other.

Figure 9:
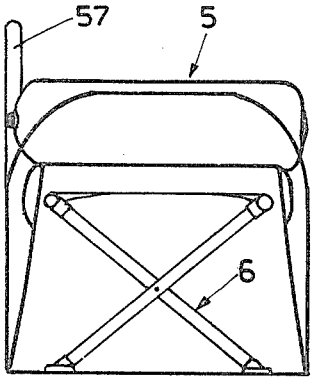
FIGS. 8, 9 and 10 represent a sofa-bed obtained by placing a covering onto a cot, respectively in front view (FIG. 8) with the cot being shown in thin lines, in side view (FIG. 9) with the cot being shown in thin lines, and in perspective view (FIG. 10).
Figure 8:
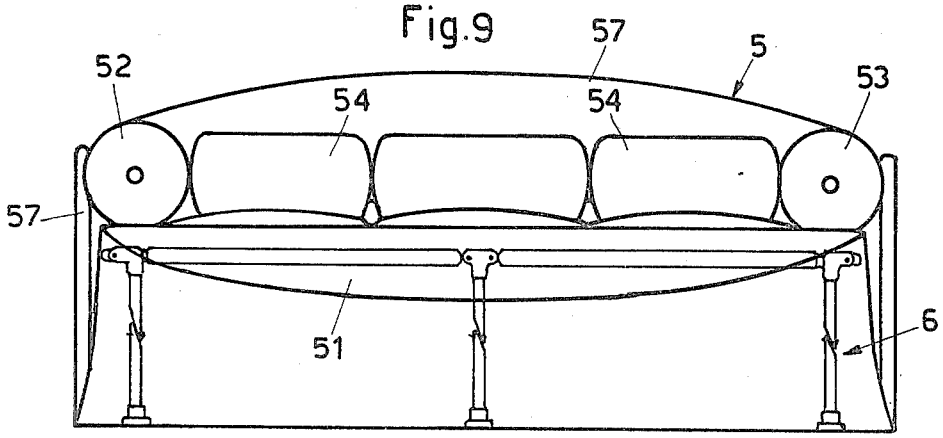
Figure 10:
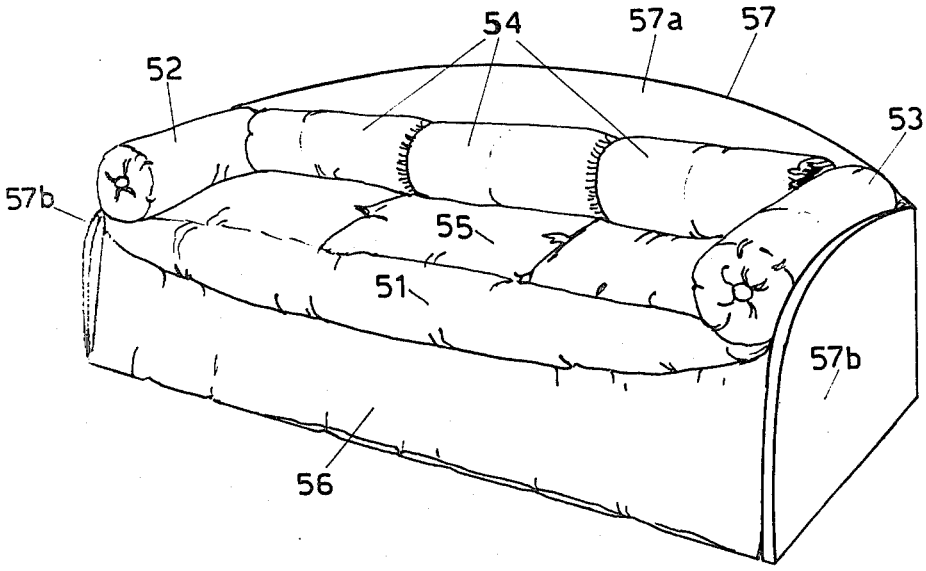
Figure 11:
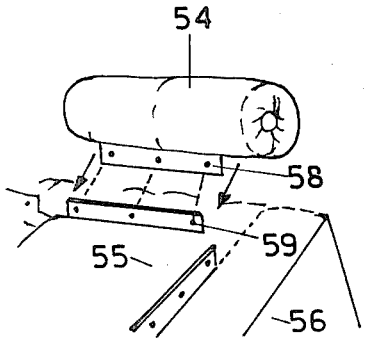
FIGS. 11 and 12 show in perspective view the details of construction of the covering for the cot.
Figure 12:
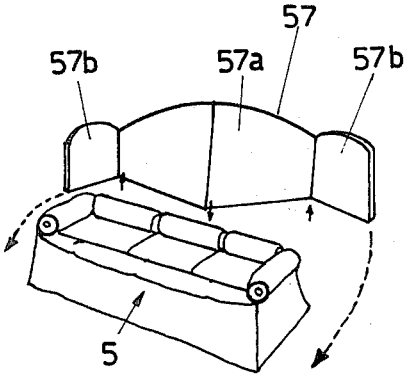

In FIGS. 8–10 there is represented a realization of the covering, indicated with 5, for a foldable cot indicated with 6. It comprises a border 51, stuffed, to cover and hide a longitudinal side of the cot. The border 51 extends along one side, and may in case extends along more sides of the cot. Preferably it will have a C-shaped configuration, in transversal section as to surround at least in part the longitudinal side of the cot. To the border 51 there is joined a stuffed seating section 55, subdivided in case in two or more sections through seams and apt to cover the cloth part of the cot. A skirt section 56, stuffed or unstuffed, straight or pleated, hangs from the covering from one or more sides and extends to the ground. Such skirt section may or may not be present. Arm rest elements 52, 53, stuffed, may or may not be present, and similarly there may or may not be present a back element 54, consisting of one or more pillows. All the elements 52, 53, 54, in the represented form of realization, actually preferred but not binding, consist of full pillows, substantially cylindrical, which are preferably applied onto the seating part 55 (FIG. 11) by means of a tab 58 extending from each pillow, which coacts with a corresponding tab 59 attached to the seat part at a certain distance from its edge, with snap buttons, slide fasteners, or the like. In this manner, for their particular disposition and mounting, the pillows forming the arm rests and the back rest result sufficiently stable to furnish a support, as is the case in the arm rests and back rest of a standard sofa. However, in order to better both the appearance and the stability of the sofa, covering 5 may be provided with, if desired, a foldable backcloth 57, disposed along one or preferably three sides of the sofa, and formed by more than one element 57*a, b,* sheetlike, connected, of any shape or material.

The covering 5 can be rapidly slipped on to and removed from the cot, with pillows 52, 53, 54 in a joined or detached position, and will generally remain on a cot in a stable position without need of any fastening means; however, it is preferred to predispose means for fastening the covering to the cot frame to prevent any sliding thereof. The covering for the cot may also be effected, as previously said with reference to the director's chair, in a material such as cloth, leather, pile, plastic material, quilted cloth or leather, without any further stuffing.

It is to be noted that the furniture piece thus obtained may be utilized not only as a sofa but also as a bed, due to the standard dimensions of the cot, by simply moving some of the cushions.

As it has been said, the described coverings can be realized in any material both as regards the actual covering and the stuffing; furthermore the covering and the eventual stuffing may be separated from each other and may be disposed one over the other on the seating structure; it is also provided that the stuffing may be realized by the utilization of inflatable bodies of suitable shape, air-inflatable or being capable of being filled with an expandable material. Buttons and other decorations may be applied in any known way as they are applied to standard stuffed materials and obviously such mode of application is not limitative of the present invention. The exterior aspect of the coverings may vary widely according to the style one wishes to achieve.

What I claim is:

1. Removable covering for a foldable chair, having arm rests, a transverse front bar, and an upper transverse bar at the back of the chair, for imparting to said chair the appearance of an upholstered piece of furniture, comprising: at least partly stuffed parts, with an internal configuration conforming relatively tightly to the foldable chair so as to cover the same and change the appearance thereof, including two stuffed arm rest parts, with a configuration adapted to conform to the arm rests of the chair, a stuffed part constituting at least in part a seating section and having a front adapted to surround the transverse front bar of the chair, a stuffed part constituting at least part of a back or head rest section, and adapted to surround the upper transverse bar, and a connecting part forming a seat and back between said front of the seating section and the head rest section.

2. Covering according to claim 1, in which the connecting part is also stuffed.

3. Covering according to claim 1, further comprising a skirt part hanging from said stuffed parts and adapted to extend all around the chair and reach the floor.

4. Removable covering for a foldable cot or the like having a front, for imparting to said cot the appearance of an upholstered piece of furniture, comprising: at least partly stuffed parts, with an internal configuration conforming relatively tightly to the foldable cot so as to cover the same and change the appearance thereof, including two stuffed arm rest parts, a stuffed part constituting at least in part a seating section and having a front adapted to surround the front of the cot, a stuffed part constituting at least part of a back or head rest section, and a connecting part forming a seat and back between said front of the seating section and the head rest section.

5. Covering according to claim 4, in which said stuffed arm rest parts, said stuffed back rest parts, and said seat sections have tongues, the tongues of said rest parts being connected to the tongues on the seat section, in a position spaced from the edge of the respective section.

6. Covering according to claim 4, in which said covering comprises a skirt section adapted to hang down to the floor on at least one side of the cot.

7. Covering according to claim 4, further comprising a back element extending along at least one side of the cot.

8. Covering according to claim 4, in which said back element is foldable.

9. Covering according to claim 1, comprising a stuffed layer and a separate covering layer, adapted to be placed in an overlapping manner onto the chair.

10. Covering according to claim 4, comprising a stuffed layer and a separate covering layer, adapted to be placed in an overlapping manner onto the cot.

* * * * *